US011399246B2

(12) United States Patent
Ginty et al.

(10) Patent No.: US 11,399,246 B2
(45) Date of Patent: Jul. 26, 2022

(54) PROTECTIVE COVER FOR A HEARING AID DEVICE

(71) Applicant: Oticon Medical A/S, Smørum (DK)

(72) Inventors: David Ginty, Smørum (DK); Per Petersen, Smørum (DK)

(73) Assignee: Oticon Medical A/S, Smørum (DK)

( * ) Notice: Subject to any disclaimer, the term of this patent is extended or adjusted under 35 U.S.C. 154(b) by 0 days.

(21) Appl. No.: 17/006,481

(22) Filed: Aug. 28, 2020

(65) Prior Publication Data

US 2021/0067886 A1 Mar. 4, 2021

(30) Foreign Application Priority Data

Aug. 29, 2019 (EP) ..... 19194269

(51) Int. Cl.
*H04R 25/00* (2006.01)

(52) U.S. Cl.
CPC ..... *H04R 25/658* (2013.01); *H04R 2225/021* (2013.01); *H04R 2225/77* (2013.01)

(58) Field of Classification Search
CPC ... H04R 1/02; H04R 1/00; H04R 1/10; H04R 1/1008; H04R 1/105; H04R 1/1066; H04R 1/109; H04R 1/1091; H04R 5/00; H04R 5/033; H04R 5/0335; H04R 25/00; H04R 25/02; H04R 25/55; H04R 25/556; H04R 25/60; H04R 25/607; H04R 25/65; H04R 25/652; H04R 2201/00; H04R 2201/021; H04R 2225/00; H04R 2225/021; H04R 2225/0213; H04R 2460/17
See application file for complete search history.

(56) References Cited

U.S. PATENT DOCUMENTS

| | | | | |
|---|---|---|---|---|
| 9,398,384 | B2 | 7/2016 | Harte et al. | |
| 2012/0189148 | A1 | 7/2012 | Bewley et al. | |
| 2015/0163607 | A1* | 6/2015 | Harte | H04R 25/658 381/322 |
| 2016/0023816 | A1* | 1/2016 | Giraud | B65D 43/16 220/263 |

* cited by examiner

*Primary Examiner* — Walter F Briney, III
(74) *Attorney, Agent, or Firm* — Birch, Stewart, Kolasch & Birch, LLP

(57) ABSTRACT

An object of the present disclosed is to provide a protective cover for a hearing aid device which comprises a cover formed from a substantially flexible material, and where the cover may have a first area with a first hardness and a second area with a second hardness.

20 Claims, 8 Drawing Sheets

PROTECTIVE COVER FOR A HEARING AID DEVICE

TECHNICAL FIELD

The present disclosure relates to hearing aid devices. More particularly, the disclosure relates to a protective cover for a hearing aid system.

BACKGROUND

Individuals who suffer for deafness due to sensorineural hearing loss can be equipped with an implantable prosthesis that can stimulate the auditory nerve cells and thereby create a sensation of sound. The system consists of an external device that collect and process the sound. The acoustical input is captured by microphones that is transformed to an electronic output which is transferred through a cable to a coil that is placed on the skin. The coil transfers the output through the skin to an implanted device. The implanted device transfers the signal to the auditory nerves that is stimulated to provide a sensation of sound. Such systems are given to individuals with no or very little hearing due to the absence or destruction of the cochlear hair cells. This makes it essential that the system works in all situations and environments.

Current systems are designed to be used in most environment, but especially the external hearing prosthesis sound processor can be vulnerable to very tough environments during an active lifestyle such as going swimming, kayaking or bathing. The devices are costly pieces which may for some users results in avoiding these situations by restricting their choice of living. In other cases, individuals with implantable prosthesis will go without their external device and thereby limiting their ability to hear and putting themselves in unnecessary dangers.

Designing a device to handle all situations, going beyond typical use, will influence the aesthetics and acoustical performance, which is not desirable during normal usage. Therefore, a protective cover which can be pulled over parts of a hearing aid system would be desirable for providing extra resistance to water, dust and other contaminants. This ensures that an active lifestyle can be pursued without worries regarding extra costs or dangers due to impaired hearing. The protective casing is required to be easy to apply, repellent to water and tough enough to handle different environments.

U.S. Pat. No. 9,398,384 B2 discloses a protective sleeve for an external component of a hearing prosthesis. The protective sleeve comprises a shell formed from a substantially flexible material; a plug port in the shell that is surrounded by a portion of the substantially flexible material, and a substantially rigid port ring disposed around the portion of the substantially flexible material surrounding the plug port. When a plug is inserted into the plug port, the port ring operates with the plug to deform the portion of the substantially flexible material surrounding the plug port to seal the plug in the shell. FIG. 1 illustrates the protective sleeve.

SUMMARY

An object of the present disclosure is to provide a protective cover for a hearing aid device with improved sealing to prevent water and dirt to enter the protective cover and damage the hearing aid device.

An aspect of the present disclosure is to provide a protective cover for a hearing aid device configured to be worn on and behind an ear of a user of the hearing aid device, where the protective cover including the hearing aid device is configured to be worn on and behind an ear of the user. The protective cover comprises a cover formed from a substantially flexible material, and where the cover may have a first area with a first hardness and a second area with a second hardness. The second hardness may be harder than the first hardness.

The hearing aid device is configured to improve a user's ability to hear by modifying an acoustical signal received by microphones of the hearing aid device. The modification may include amplification, preserve spatial cues in the modified acoustical signal, noise cancellation etc. For obtaining an optimal modification of the acoustical signal, the placement of the microphones of the hearing aid device relative to ear and head should be fixed and pre-defined in the process for providing the modification of the acoustical signal. Therefore, it is an advantage that a hearing aid device configured to be worn on and behind an ear of a user is able to be placed at the position when being arranged within the protective cover. Thereby, on optimal enhancement of the user's ability to hear is the same whether the hearing aid device is arranged within or outside the protective cover.

The cover may be made of a flexible silicone material having an ear surface with a coefficient of friction from 1 and above. The advantage of having an ear surface with a coefficient of friction from 1 and above avoids the protective cover to slide off the ear. Thereby, the placement stability of the protective cover is improved even more.

A subpart of the first area of the cover may have a hardness which is harder than the remaining parts of the first area, and the subpart faces towards the ear when the protective cover is being worn intentionally by a user. The subpart having a hardness which is harder than the remaining part of the first area makes it easier for the user to apply the hearing aid device within the protective cover. The reason is that the risk of folding the protective cover when applying the hearing aid device into the cover is significantly reduced.

The cover may comprise an ear surface facing towards the ear when the protective cover is being worn intentionally by a user, and the ear surface extends at least in the first area, and the hardness of the ear surface is harder than the remaining surfaces of the cover within at least the first area.

The cover may be made of a substantially flexible material with different hardness. The hardness at a specific area of the cover depends on the function of the cover at that area. The difference in hardness of the cover can either be made by using different type of substantially flexible material, by molding tracks in the cover wherein the tracks are configured to stiffen the substantially flexible material at the area which includes the tracks, or by applying a rigid brace to the cover which is configured to stiffen the cover where the rigid brace is placed. The rigid base may either be molded into the cover or applied on a surface of the cover.

The rigid brace may be molded into the cover. The rigid brace may be made of plastic or hard silicone.

For improving the bonding between the cover and the rigid brace, the rigid brace may include multiples holes configured to receive the substantially flexible material of the cover during integration of the rigid brace. The integration of the rigid brace may be done during molding of the cover, i.e. the protective cover.

The cover may have a main opening configured to receive a hearing aid device, and the main opening is arranged in the second area of the cover. Furthermore, the cover includes a plurality of lips formed on a surface of the cover in the second area, and a closing mean configured to be applied on to the cover and for encompassing the at least plurality of lips for sealing the hearing aid device in the cover. The closing mean may be disposed around the portion of the cover which includes the plurality of lips such that main opening is closed and at least a part of the hearing aid device is sealed within the cover. When the closing mean is disposed around the portion, the closing mean operates with the plurality of lips and deforms the plurality of lips such that a sealing is obtained between the closing mean and the cover. In other example the hearing aid device may be part of the sealing.

In view of the known art, the advantage of applying the plurality of lips on the cover and that the closing mean is applied on to the cover encapsulating or surround the plurality of lips is that the sealing of at least a part of the hearing aid device is improved. The reason for the improvement is that when the hearing aid device is applied within the cover and the closing mean is applied onto the cover surrounding or encapsulating the plurality of lips, a sealing effect is obtained between the hearing aid device and the second area of the cover and between the closing mean and the second area of the cover. In this example, the hearing aid device should have a size which at least partly overlaps the second area of the cover. If the size of the hearing aid device is not enough to overlap at least partly the second area then a base plug may be inserted into the cover via the main opening taking up the space below the hearing aid device within the cover overlapping the partly or fully the second area. In the known art a sealing effect is only obtained between the closing mean and the cover when the hearing aid device is placed within the cover.

The cover is not acting as the closing mean. The closing mean does not comprise the plurality of lips.

The plurality of lips may be arranged around the main opening, or circumferential to the main opening.

When the closing mean is in an open position, the main opening is not closed, and when the closing mean is in a close position, the main opening is closed. When the closing mean is in the close position, the plurality of lips is in contact with the closing mean providing an improved sealing between the closing mean and the cover.

The second hardness being harder than the first hardness provides an improved sealing of the main opening when the closing mean is applied into the closing position. Furthermore, the difference in hardness makes it easier for the user to apply the hearing aid device within the protective cover.

The cover may have an outer surface and an inner surface, and when the protective cover comprises a hearing aid device the outer surface is directed away from the hearing aid device and the inner surface is directed towards the hearing aid device.

The plurality of lips may include multiple protrusions applied on a surface of the cover. More specifically, the plurality of lips may be formed on the outer surface of the protective cover. The closing mean may be a lid, and when applying the closing mean into close position, a part of the closing mean is covering the main opening and another part of the closing mean applies a compression force onto the plurality of lips resulting in a sealing of the main opening. The closing mean may apply a clamping force onto the plurality of lips resulting in a deformation of the plurality of lips. The deformation of the plurality of lips results in an improved sealing.

The another part of the closing mean may be shaped as a collar with a certain height configured to encompass the plurality of lips.

The protective cover may include a hinge system configured to receive the closing mean, and the closing mean can be moved into an open position and a close position. When the closing mean is in the close position, the plurality of lips are in contact with the closing mean providing an improved sealing between the closing mean and the cover. When the closing mean is in the open position a hearing aid device can be inserted into the protective cover.

The plurality of lips may be formed on an inner surface of the cover, and the closing mean may be a ring formed from a substantially flexible material configured to provide a compression force at least onto the part of the cover which includes the plurality of lips, and the compression force results in a sealing between the plurality of lips and the hearing aid device when being inserted into the main opening.

The part of the hearing aid device which is not sealed from being in contact with, e.g. water, is waterproofed.

The substantially flexible material may be silicone or any kind of water-resistant material. The protective cover is adapted to different sizes of a hearing aid device. In that regards, when the hearing aid device has a size which is not able to fill out the cover when inserted, then the protective cover may include a base plug configured to be inserted into the main opening and arranged at the second area of the cover, i.e. the base plug is arranged beneath the hearing aid device. A sealing effect is obtained between the base plug and the second area of the cover and between the closing mean and the second area of the cover. Furthermore, it is obtained an optimal position of the hearing aid device within the protective plug which further result in an improved wearing comfort of the protective cover when including the hearing aid device, because the hearing aid device will be kept in a more fixed position when the user is moving around. Without the base plug the hearing aid device will be moved around within the cover when the user is moving resulting in less wearing comfort.

The base plug may be part of the closing mean or as a separate unit to the protective cover. The base plug may be attachable and detachable to the closing mean.

A hearing aid device may not take up all space within the protective cover, and in that regards, the base plug may be inserted into the main opening taking up available space fully or partly within the protective cover, i.e. at the second area of the cover, and where the available space is not taken up by the hearing aid device. The ring is then applied around the protective cover configured to provide a compression force at least onto the part of the cover which includes the plurality of lips, and the compression force results in a sealing between the plurality of lips and the hearing aid device when being inserted into the main opening.

A part of the closing mean may be attached or integrated into the cover. The advantage of having a part of the closing mean attached or integrated into the cover is that the user would not be able to separate the closing mean from the protective cover with the risk of losing the closing mean.

The protective cover may include at least one guiding mean formed on at least a first outer surface of the cover in the second area, and the at least one guiding mean is configured to guide the closing mean when the guiding mean is encompassing at least the plurality of lips.

When the closing mean is a ring, and the ring is applied around the protective cover, the guiding mean prevents the ring from sliding off the first outer surface of the cover, resulting in no compression force. Thereby, the advantage of have a guiding mean is a more secured closing of the main opening, i.e. an improved sealing is obtained.

The guiding mean may include one or more elements protruding out from the outer surface of the cover. The one or more elements may include at least a first element and a second element, and the first and the second element may be arranged such that a space between the two elements is generated, and the ring is configured to be applied onto the outer surface of the cover and within the space between the two elements.

By having two elements then the ring is not able to slide in any directions, and thereby, the advantage of having the two elements is an even more secured closing of the main opening.

The protective cover may comprise at least a first guiding mean and at least a second guiding mean formed on a first outer surface and a second outer surface of the cover in the second area, respectively. In another example, the at least second guiding mean may be arranged on the same surface as the first guiding mean. In this example, the first guiding mean may be separated from the second guiding mean. This solution provides a more secured closing of the main opening when at least a part of the ring is not integrated or molded onto the cover.

When a hearing aid device is arranged within the protective cover, the cover would act as a damper of the acoustic wave going into microphones of the hearing aid device. In order to reduce the damping, then at least one microphone window may be formed into the cover, and where the at least one microphone window is aligned with one or more microphone inlets of the hearing aid device, when the hearing aid device is arranged within the cover. The at least one microphone window is aligned with the one or more microphone inlets such that the acoustic waves pass through the at least one microphone window and directly into the one or more microphone inlets.

The at least one microphone window shall still prevent the water to access the hearing aid device. Therefore, the at least one microphone window may be formed either by reducing the thickness of the flexible material of the cover at the at least one microphone window or by applying a different material to the cover at the at least one microphone window.

The thickness of the substantially flexible material of the at least one microphone window is thinner than the remaining parts of the cover.

When the user is wearing the protective cover including a hearing aid device, the user may experience acoustic defects, such as scratching sounds from the contact between the cover and the microphone inlets. To solve the problem, the cover may comprise one or more protrusions extending outwards from an inner surface of the cover, securing an air gap between the microphone window and the microphone inlets. The one or more protrusions are arranged in vicinity to the microphone window, and the one or more protrusions provides the air gap between an inner surface of the microphone window and the one or more microphone inlets.

The one or more protrusions prevent the cover from touching the microphone inlets, when the hearing aid device is arranged within the cover.

The one or more protrusions may be formed such that it is arranged circumferential to the microphone window.

The one or more protrusions may be formed such that it is arranged around the microphone window.

The one or more protrusions may be a single circular shaped protrusion, or the more protrusions may include multiple square shaped or circular shaped protrusions.

The protective cover may comprise a rigid ear hook formed into the substantially flexible material of the cover, and the rigid ear hook comprises one or more holes configured to receive the substantially flexible material of the cover. The one or more holes improves the integration of the rigid ear hook into the cover. For example, during molding of the rigid ear hook into or onto the cover, the substantially flexible material will go into the holes of the rigid ear hook resulting in an improved bonding between the rigid ear hook and the cover.

The hearing aid device may be part of a cochlea hearing aid system, wherein the cochlea hearing aid system further includes an external sound processor, a sound implant and an electrode array or a vibrator implant, and wherein a connection from the hearing aid device to the external sound processor includes a plug and a wire, where the plug is connected to the wire. The external sound processor may be connected to a sound implant via an inductive link, and the sound implant is wired connected to either the electrode array or the vibrator implant. The sound implant, the electrode array and/or the vibrator implant are arranged below a skin of the user of the cochlear hearing aid system.

The electrode array and the vibrator implant are configured to stimulate the auditory nerves of the cochlea of the user via electrical stimulation or mechanical stimulation, respectively.

The protective cover may include a rigid locking mean, where the rigid locking mean includes a receive part and a lock part. The receive part may be configured to receive the plug, and the lock part may be configured to lock and seal the plug to the cover.

The receive part may be a hole formed into the cover, and when the plug is inserted into the hole and turned, then the lock part is configured to grab the plug such that the user is not able to pull out the plug from the receive part.

The receive part may have an opening including a first longitudinal axis, and the plug may have locking means arranged along a second longitudinal axis. When the locking means are in a first position, the first longitudinal axis and the second longitudinal axis are in parallel, and thereby, the locking means fit into the opening allowing the plug to be received by the receive part. When rotating the plug to a second position, the first and the second longitudinal axis are no more in parallel, and thereby, the opening is the lock part because the locking means can no more be pulled out from the receive part.

The lock part may include mechanical means configured for fixate the locking means into the second position. The mechanical means are then configured to release the locking means when the user applies a force onto the plug in a direction orthogonal to the first or second longitudinal axis and rotating the plug such that the first longitudinal axis and the second longitudinal axis are in parallel.

BRIEF DESCRIPTION OF DRAWINGS

The objects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each object may each be combined with any or all features of the other objects. These and other objects, features and/or technical effect will be apparent from and elucidated with reference to the illustrations described hereinafter in which:

DETAILED DESCRIPTION

Figure 1:
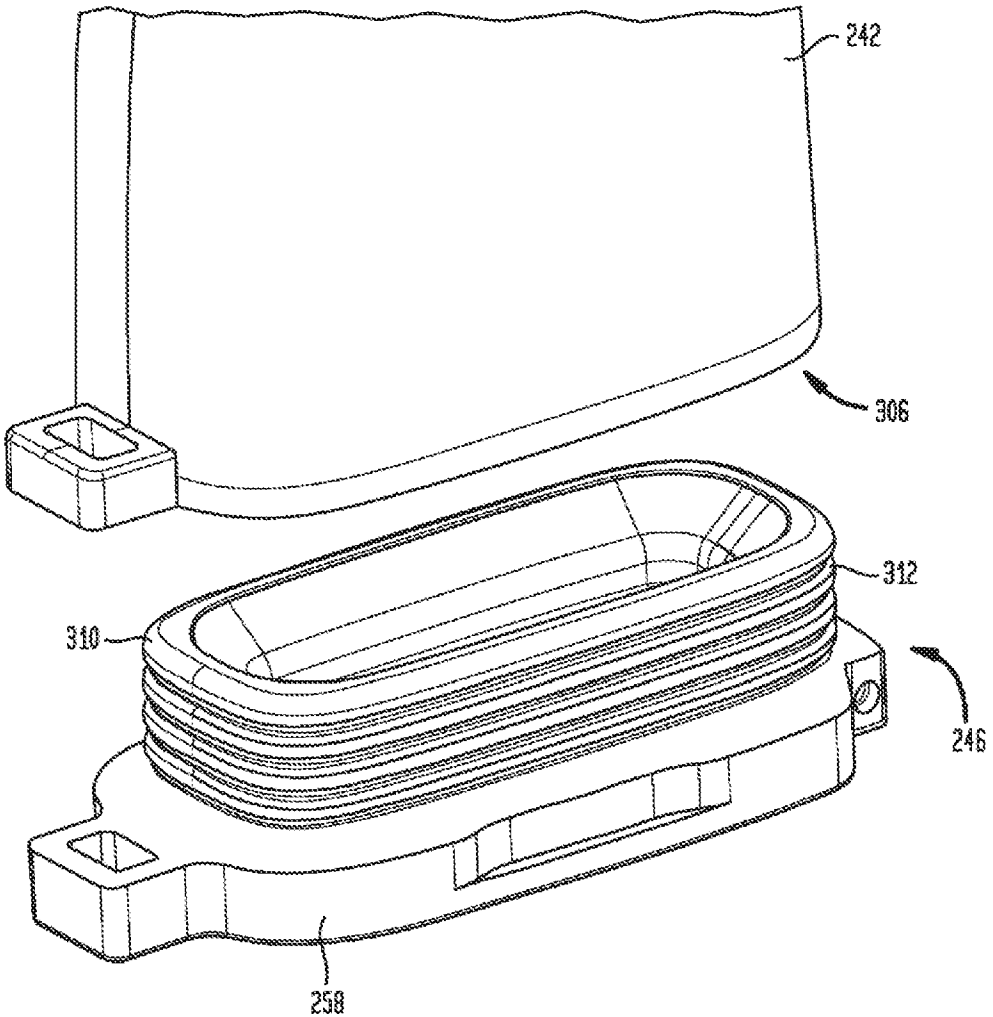
FIG. 1 illustrates a protective cover described in a known art.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details.

A hearing aid device, such as an implant unit and/or a sound processor, may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. Such audible signals may be provided in the form of an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way on, within or around the head of the user. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

In general, a hearing device, such as an implant unit and/or a sound processor unit includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

Figure 2B:
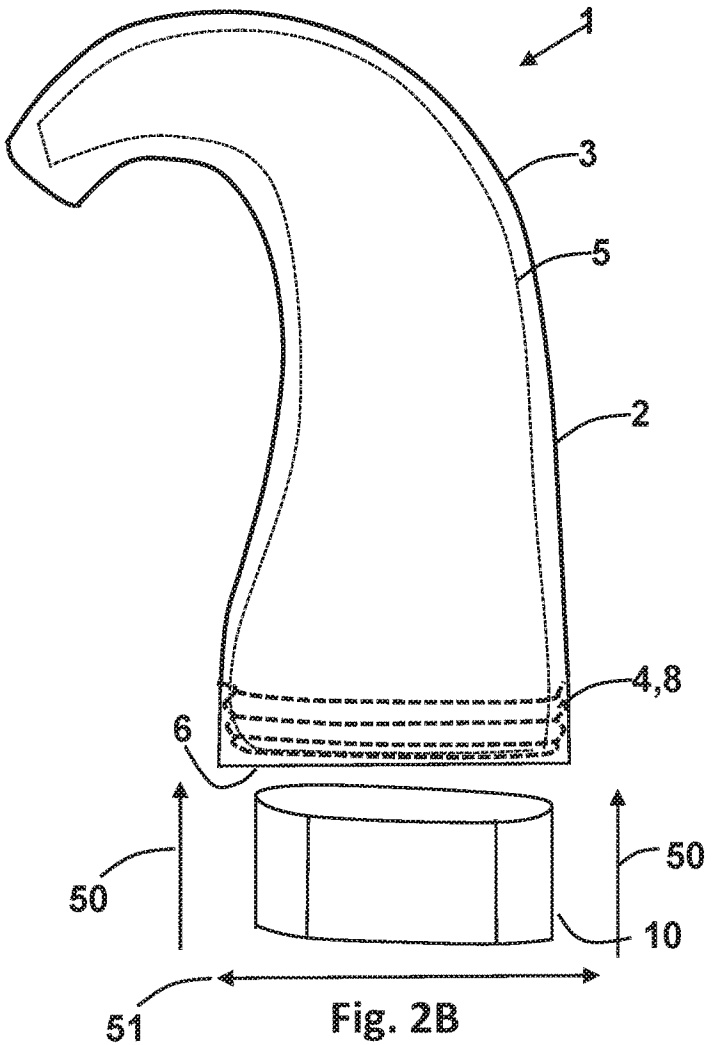
FIGS. 2A and 2B illustrate different example of a protective cover.
Figure 2A:
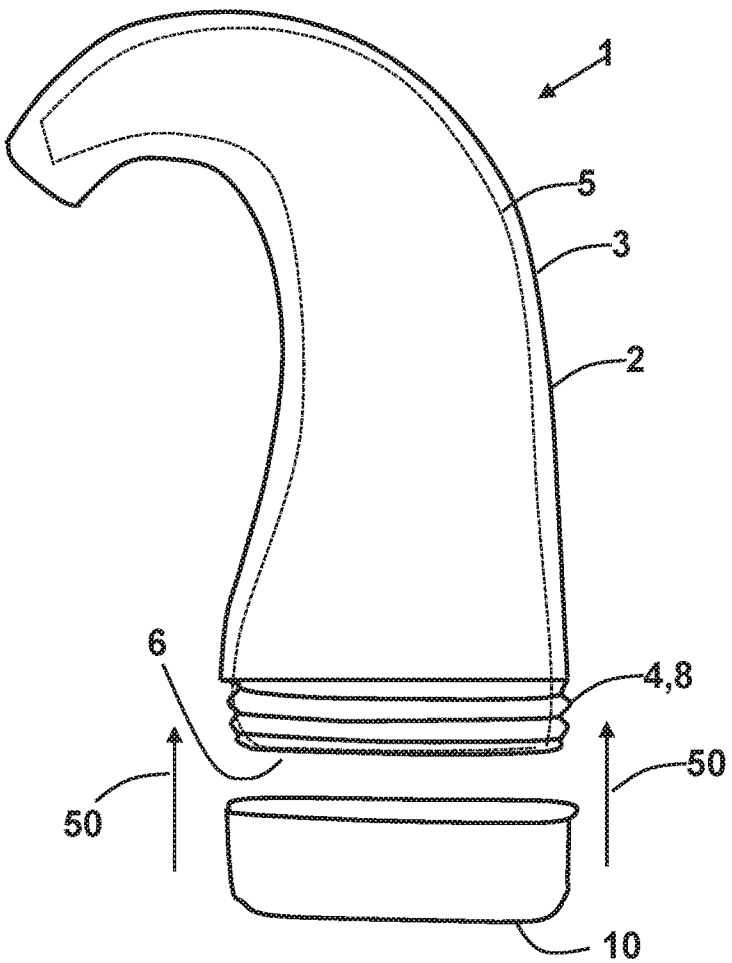

FIGS. 2A and 2B illustrate both a protective cover for a hearing aid device with different examples on a closing mean. In both figs the protective cover 1 includes a cover 3 formed from a substantially flexible material, where the cover 3 has a first area 2 with a first hardness and a second area 4 with a second hardness, and the cover 3 has a main opening 6 configured to receive a hearing aid device 5, and the main opening 6 is arranged in the second area 4 of the cover 3. A plurality of lips 8 is formed on a surface of the cover in the second area 4, and a closing mean 10 is configured to be applied on to the cover 3 for encompassing the at least plurality of lips 8 for sealing the hearing aid device 5 in the cover 3.

More specifically, in FIG. 2A, the plurality of lips 8 is formed on an outer surface of the cover 3, and the closing mean 10 is a lid where a part of the lid is covering the main opening 6 and another part of the closing mean 10 applies a compression force to the plurality of lips resulting in a sealing of the main opening. The arrows 50 indicate the direction of the applying of the closing mean onto the cover 3.

In FIG. 2B, the plurality of lips is formed on an inner surface of the cover 3, and the closing mean 10 is a ring formed from a substantially flexible material configured to provide a compression force between the plurality of lips 8 and the hearing aid device 5 when being inserted into the main opening. The arrow 51 indicates that the closing mean is at least flexible or elastic in the direction of the arrow 51. The flexibility improves the sealing between the closing mean 10 and the cover 3 and between the hearing aid device 5 and the cover 3.

Figure 3:
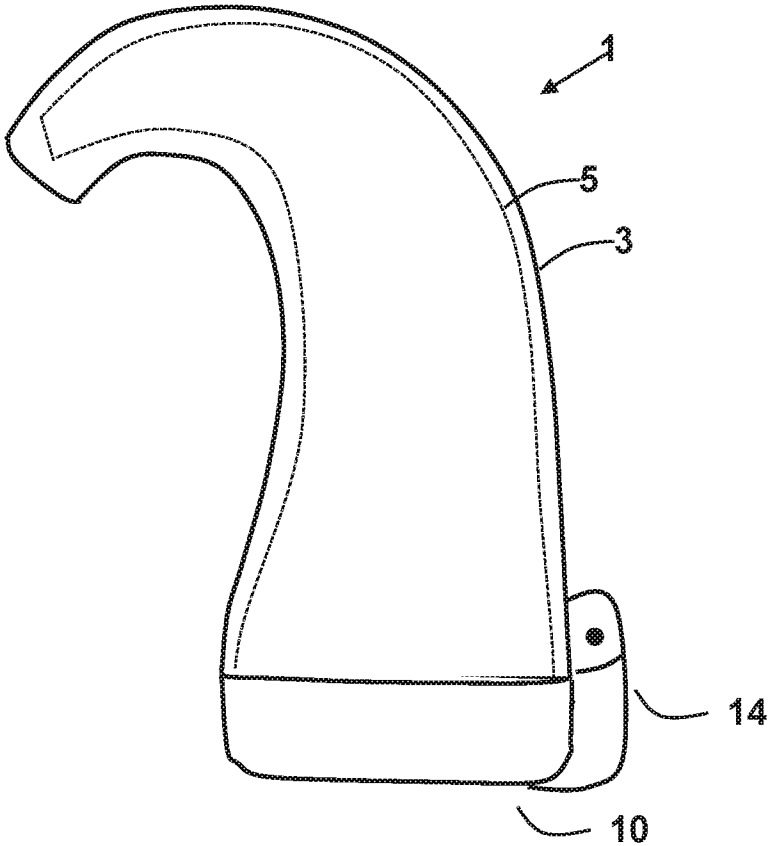
FIG. 3 illustrates an example of a protective cover.

FIG. 3 illustrates the protective cover with a hinge system 14, wherein the hinge system 14 is fixedly secured onto an outer surface of the cover 3, and connects the closing mean 10 to the cover 8 such that the closing mean 10 can be closed or open without the closing mean is removed from the protective cover 1. The hinge system 14 can be designed differently from what is illustrated in FIG. 3.

Figure 4:
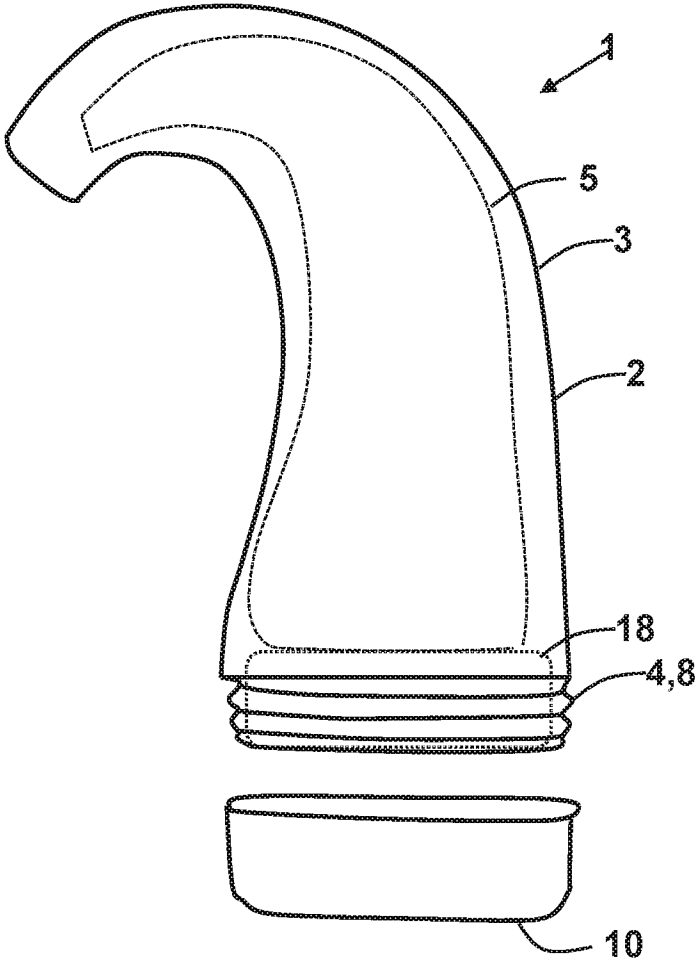
FIG. 4 illustrates an example of a protective cover.

FIG. 4 illustrates the protective cover 1 where the hearing aid device 6 within the cover 3 does not have a size which covers the second area 4 of the cover 3. In this example, the protective cover 1 includes a base plug 18 which is configured to be inserted into the main opening and arranged at the second area 4 of the cover 3. The closing mean 10 can be of any type including the examples described in present disclosure, however though, the closing mean 10 has to provide a clamping force onto the second area 4 of the cover 3 which will result in a deformation of the plurality of lips 8.

Figure 5B:
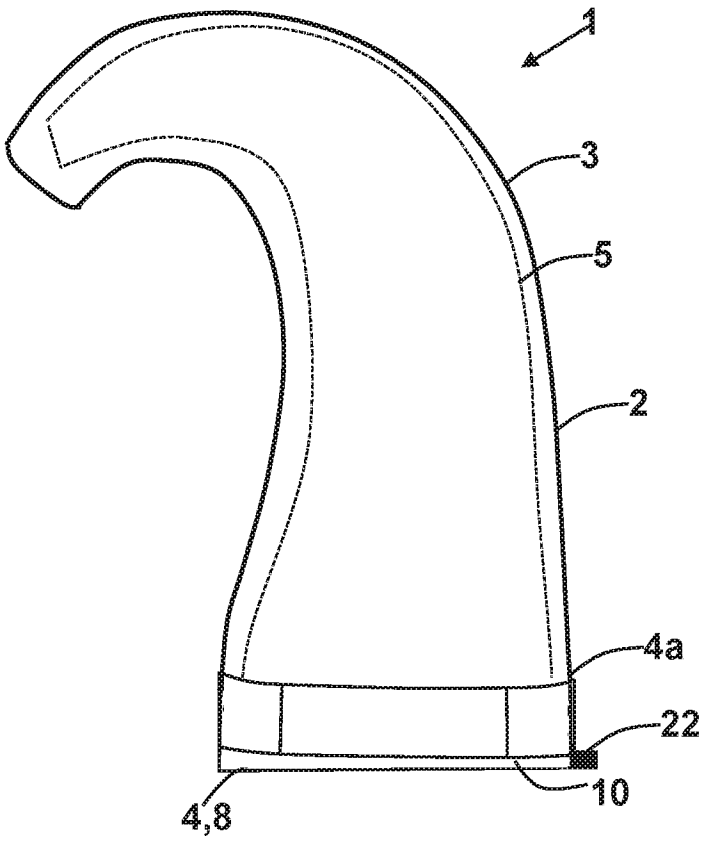
FIGS. 5A to 5E illustrate different example of a protective cover.
Figure 5A:
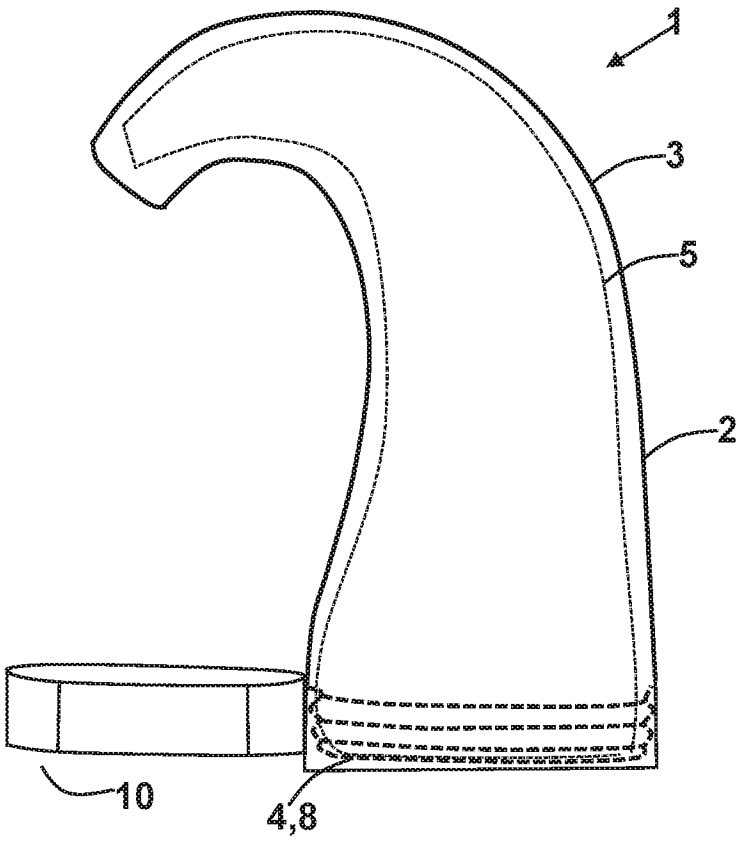
Figures 5C, 5D, 5E:
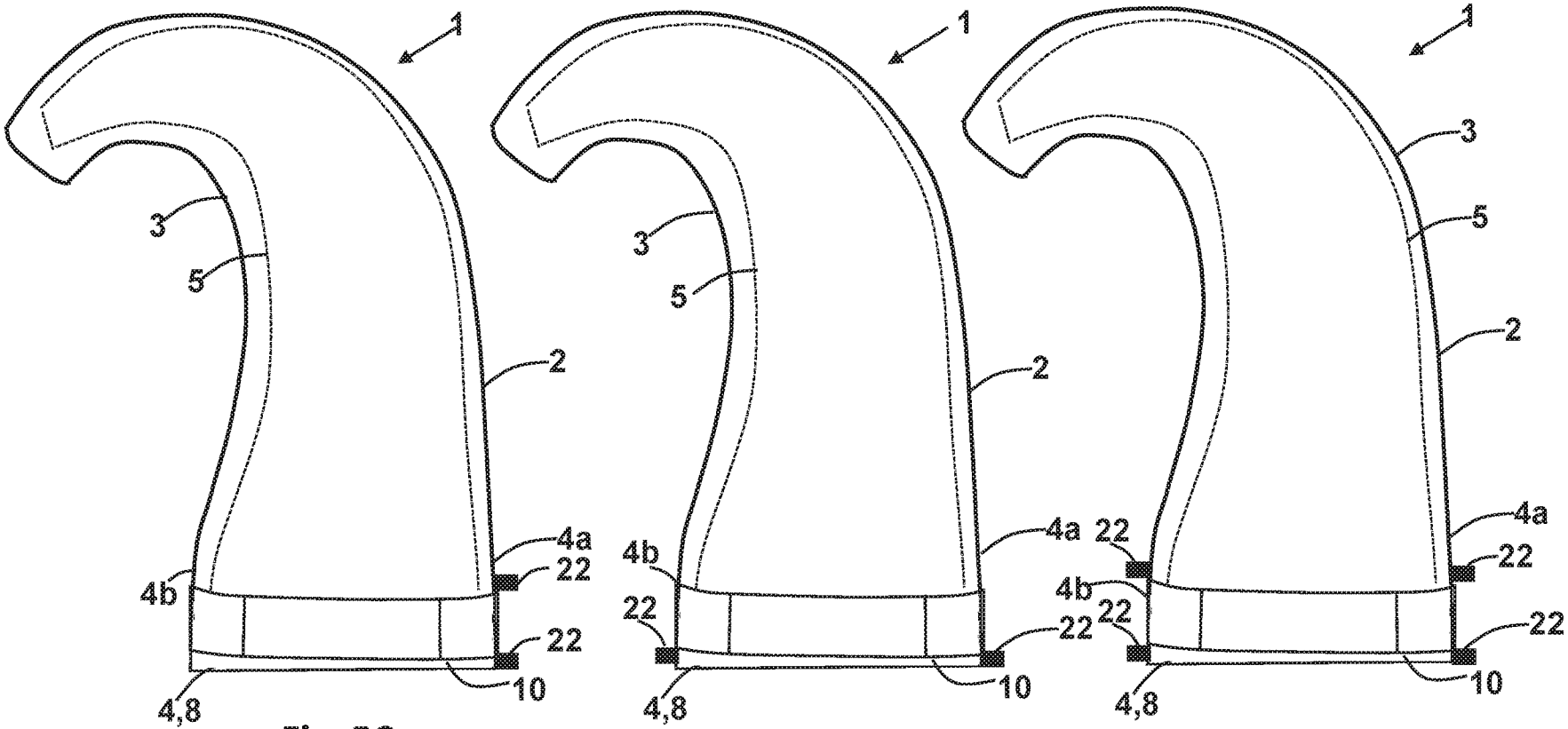

FIG. 5A illustrates the protective cover 1 where a part of the closing mean 10 is integrated into the cover 3, and FIG. 5B illustrates the protective cover 1 comprising at least one guiding mean 22 formed on at least a first outer surface 4*a* of the cover 3 in the second area 4, and where the at least one guiding mean 22 is configured to guide the closing mean 10 when the guiding mean 10 is encompassing at least the plurality of lips 8. In this example, the closing mean 10 may be integrated or fixedly secured to the cover 3, and the guiding mean 22 prevents the closing mean 10 to slide off the cover 3 when being applied onto the cover 3 encompassing the plurality of lips 8. FIG. 5 C illustrates an example where two guiding means 22, including a first guiding mean 22 and a second guiding mean 22, are applied on the first outer surface 4*a*. In this example the closing mean 10 is prevented from sliding off the ideal position of the closing mean when wanting an optimal sealing of at least a part of the hearing aid device 5. FIG. 5D illustrates an example where a guiding mean 22 is arranged on both the first outer surface 4*a* and the second outer surface 4*b*. In this example the closing mean 10 is not integrated or fixedly secured onto the cover 3. FIG. 5E illustrates yet another example where at least two guiding means are arranged onto the first outer surface 4*a* and onto the second outer surface 4*b*. In this example the closing mean 10 is not integrated or fixedly secured onto the cover 3.

Figure 6:
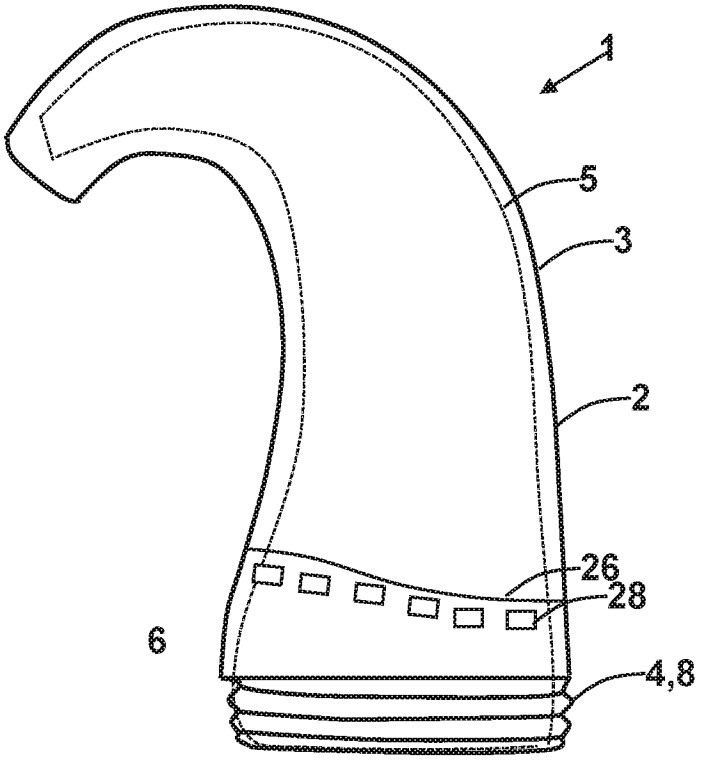
FIG. 6 illustrates an example of a protective cover.

FIG. 6 illustrates the protective cover 1 including a rigid brace 26 integrated or moulded into the cover 3 at the second area 4. In this example the plurality of lips 8 is formed on the outer surface of the cover 3, but the rigid brace 26 is also applicable when the plurality of lips 8 is formed on the inner surface of the cover 3. For improving the integration of the rigid brace 26, the rigid brace includes multiple holes 28.

Figure 7:
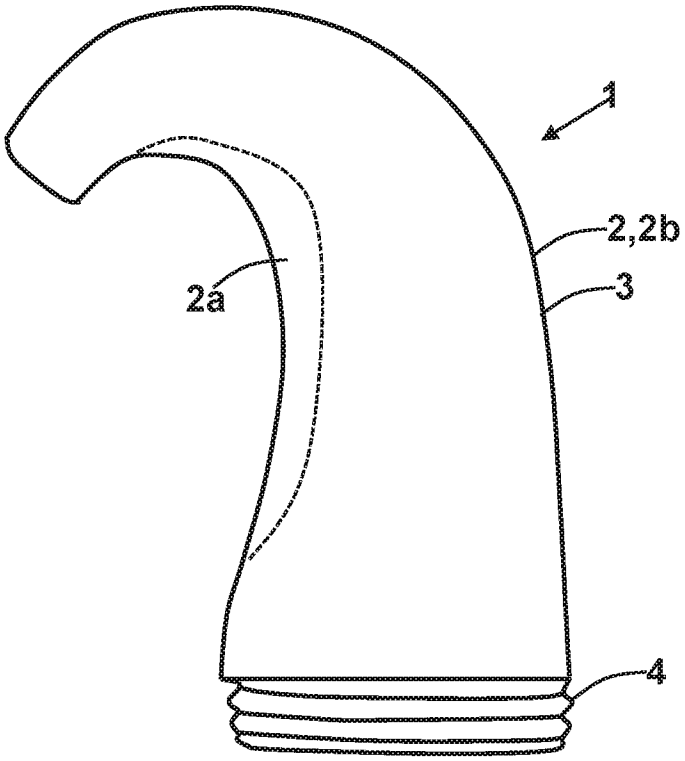
FIG. 7 illustrates an example of a protective cover.

FIG. 7 illustrates the protective cover 3 where a subpart 2*a* of the first area 2 of the cover 3 has a hardness which is harder than the remaining parts 2*b* of the first area 2, and the subpart 2*a* is facing towards the ear when the protective cover 1 is being worn intentionally by a user. The subpart is also applicable when the plurality of lips 8 is formed on the inner surface of the cover 3.

Figure 8B:
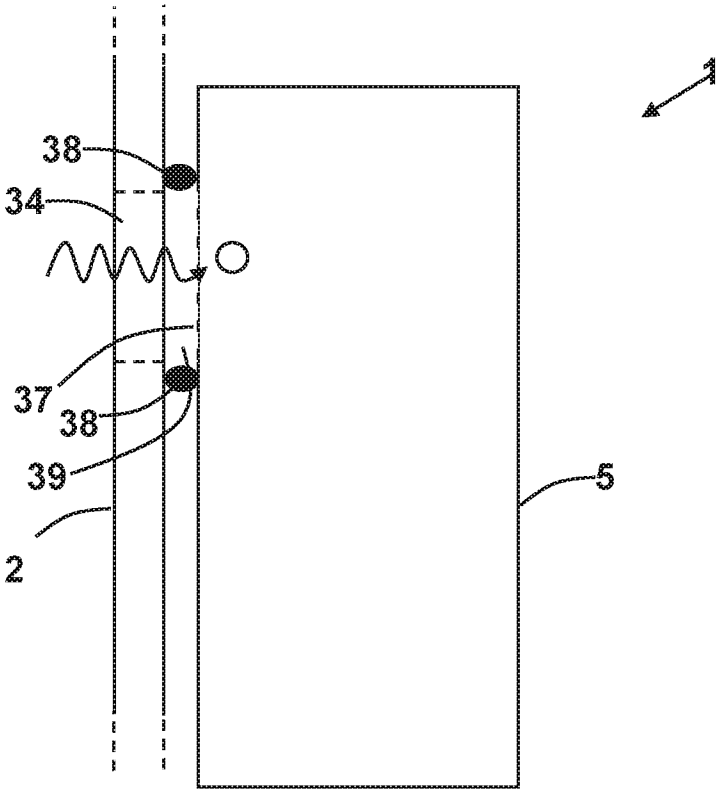
FIGS. 8A and 8B illustrate an example of a protective cover.
Figure 8A:
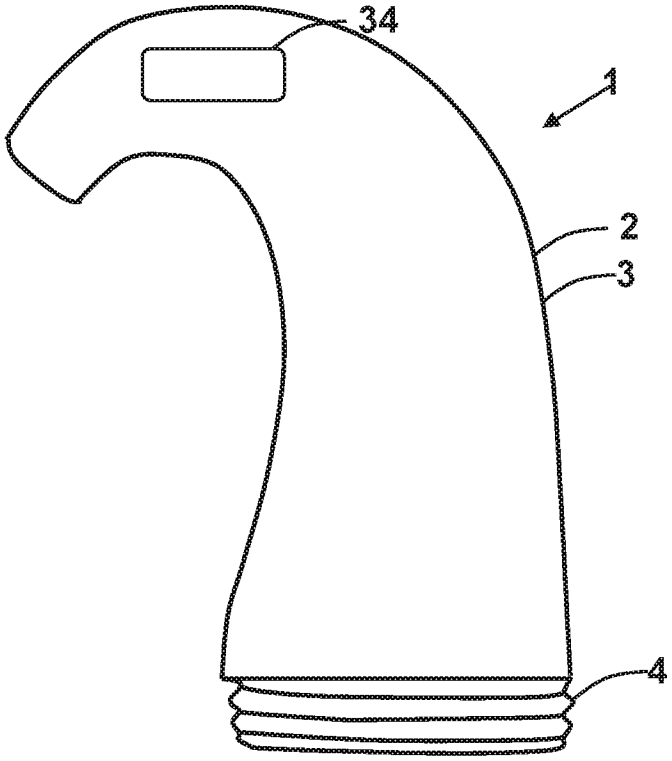

FIGS. 8A and 8B illustrate the protective cover 3 including at least one microphone window 34 is formed into the cover 3, and where the at least one microphone 34 window is aligned with one or more microphone inlets 37 of the hearing aid device 5, when the hearing aid device 5 is arranged within the cover. The thickness of the substantially flexible material of the at least one microphone window 34 may be thinner than the remains of the cover 3. FIG. 8*b* illustrates the protective cover 1 including one or more protrusions 38 extending outwards from an inner surface of the cover 3, and the one or more protrusions 38 are arranged in vicinity to the microphone window 34, and the one or more protrusions 38 provides an air gap 39 between an inner surface of the microphone window 34 and the one or more microphone inlets 37.

Figure 9B:
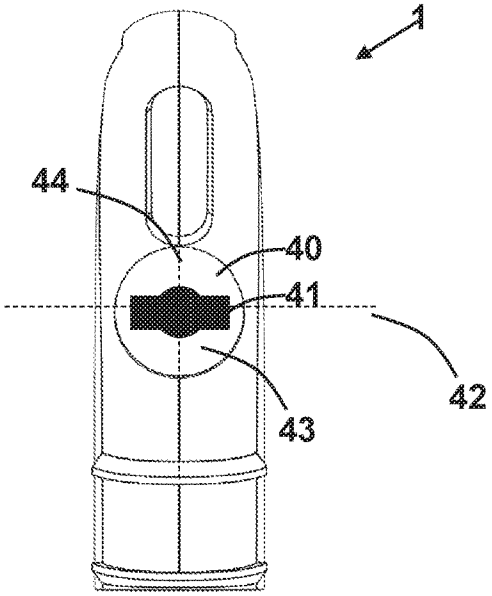
FIGS. 9A and 9B illustrate an example of a protective cover.
Figure 9A:
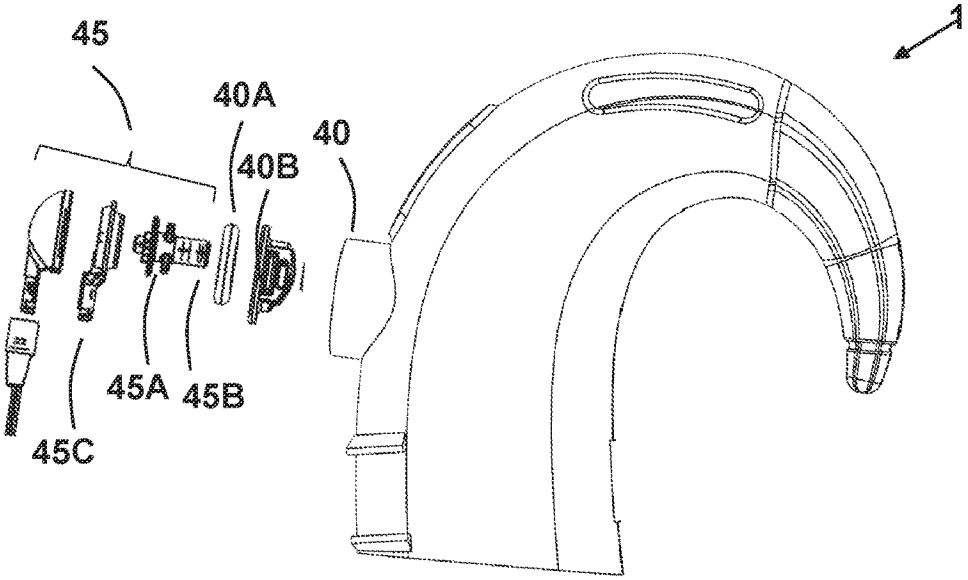

FIGS. 9A and 9B illustrate the protective cover 1 including a rigid locking mean 40. The rigid locking mean 40 includes a receive part 41 and a lock part 43, where the receive part 41 is configured to receive a plug 45, and the lock part 43 is configured to lock and seal the plug 45 to the cover 3. In FIG. 9A, the rigid locking mean 40 includes a sealing element 40A, e.g. a ring sealer, and a part 40B which includes the receive part 41 and the lock part 43. Furthermore, the plug 45 includes at least two leg means 45A protruding radially out from an elongated plug 45B which is configured to connect to the hearing device arranged within the cover 1. The at least two leg means 45A are configured to be inserted into the receive part 41 and turned so that the lock part receives the at least two leg means 45 and the plug 45 is locked and sealed to the protective cover. The elongated plug 45B is configured to communicate audio and power to an implant. The plug 45 includes sealing elements 45C for improving even more the sealing between the plug 45 and the rigid locking mean 40.

In FIG. 9B, the receive part 41 may be an opening formed into the cover, and when the plug 45 is inserted into the opening 41 and turned, then the lock part 42 is configured to grab the plug 45 such that the user is not able to pull out the plug 45 from the receive part 41. The opening 41 is arranged along a first longitudinal axis 42, and the plug may have locking means arranged along a second longitudinal axis 44. When the locking means are in a first position, the first longitudinal axis 42 and the second longitudinal axis 45 are in parallel, and thereby, the locking means fit into the opening 41 allowing the plug 45 to be received by the receive part 41. When rotating the plug 45 to a second position, the first and the second longitudinal axis are no more in parallel, and thereby, the opening 43 is the lock part because the locking means can no more be pulled out from the receive part 41.

The invention claimed is:

1. A protective cover for a hearing aid device configured to be worn on and behind an ear of a user of the hearing aid device, where the protective cover including the hearing aid device is configured to be worn on and behind an ear of the user, the protective cover comprising:

a cover formed from a substantially flexible material, where the cover has a first area with a first hardness and a second area with a second hardness, and the cover has a main opening configured to receive a hearing aid device, and the main opening is arranged in the second area of the cover, a plurality of lips formed on a surface of the cover in the second area, and a closing mean configured to be applied onto the cover for encompassing the at least plurality of lips for sealing the hearing aid device in the cover, wherein the closing mean is applied in such manner that a part of the closing mean applies a compression force to the plurality of lips thereby deforming the plurality of lips, wherein the deformation of the plurality of lips resulting from the applied compression force causes the plurality of lips to press against part of the hearing aid device, thereby sealing the hearing aid device in the cover.

2. The protective cover according to claim 1, where the plurality of lips is formed on an outer surface of the cover, and the closing mean is a lid where a part of the lid is covering the main opening and another part of the closing mean is the part applying the compression force to the plurality of lips.

3. The protective cover according to claim 2, comprising a base plug configured to be inserted into the main opening and arranged at the second area of the cover.

4. The protective cover according to claim 2, wherein the protective cover includes a hinge system configured to attach the closing mean to the outer surface of the cover.

5. The protective cover according to claim 4, comprising a base plug configured to be inserted into the main opening and arranged at the second area of the cover.

6. The protective cover according to claim 1, where the plurality of lips is formed on an inner surface of the cover, and the closing mean is a ring formed from a substantially flexible material configured to provide the compression force between the plurality of lips and the hearing aid device when being inserted into the main opening.

7. The protective cover according to claim 6, comprising a base plug configured to be inserted into the main opening and arranged at the second area of the cover.

8. The protective cover according to claim 6, wherein a part of the closing mean is integrated into the cover.

9. The protective cover according to claim 6, wherein a first outer surface of the cover in the second area, which encompasses at least the plurality of lips, is configured to guide the closing mean.

10. The protective cover according to claim 6, wherein at least one guide is provided on an outer surface of the cover in the second area.

11. The protective cover according to claim 1, wherein the second hardness is harder or the same as the first hardness.

12. The protective cover according to claim 1, comprising a rigid brace integrated into the cover in the second area.

13. The protective cover according to claim 12, wherein the rigid brace includes multiples holes configured to receive the substantially flexible material of the cover during integration of the rigid brace.

14. The protective cover according to claim 1, wherein a subpart of the first area of the cover has a hardness which is harder than the remaining parts of the first area, and the subpart is facing towards the ear when the protective cover is being worn intentionally by a user.

15. The protective cover according to claim 1, wherein at least one microphone window is formed into the cover, and where the at least one microphone window is aligned with one or more microphone inlets of the hearing aid device, when the hearing aid device is arranged within the cover.

16. The protective cover according to claim 15, wherein a thickness of the substantially flexible material of the at least one microphone window is thinner than the remains of the cover.

17. The protective cover according to claim 15, wherein the cover includes one or more protrusions extending outwards from an inner surface of the cover, and the one or more protrusions are arranged in vicinity to the microphone window, and the one or more protrusions provides an air gap between an inner surface of the microphone window and the one or more microphone inlets.

18. The protective cover according to claim 1, wherein the cover includes a rigid locking mean, and the rigid locking mean includes a receive part and a lock part, where the receive part is configured to receive a plug, and the lock part is configured to lock and seal the plug to the cover.

19. A protective cover for a hearing aid device configured to be worn on and behind an ear of a user of the hearing aid device, where the protective cover including the hearing aid device is configured to be worn on and behind an ear of the user, the protective cover comprising:

a cover formed from a substantially flexible material, where the cover has a first area with a first hardness and a second area with a second hardness, and the cover has a main opening configured to receive a hearing aid device, and the main opening is arranged in the second area of the cover, a plurality of lips formed on a surface of the cover in the second area, a closing mean configured to be applied onto the cover for encompassing at least the plurality of lips for sealing the hearing aid device in the cover, and a base plug configured to be inserted into the main opening and arranged at the second area of the cover.

20. The protective cover according to claim 19, wherein a part of the closing mean is integrated into the cover.

* * * * *